US006004062A

United States Patent [19]

Hunter et al.

[11] Patent Number: 6,004,062

[45] **Date of Patent: *Dec. 21, 1999**

[54] INDEX DIVIDER SHEET ASSEMBLY AND THE LIKE

[75] Inventors: Jeffrey C. Hunter, Riverside; Sonia Owen, Covina; Gustav Allen Ray, Huntington Beach, all of Calif.

[73] Assignee: Avery Dennison Corporation, Pasadena, Calif.

[ * ] Notice: This patent is subject to a terminal disclaimer.

[21] Appl. No.: 09/057,177

[22] Filed: Apr. 8, 1998

Related U.S. Application Data

[63] Continuation of application No. 08/698,710, Aug. 16, 1996, Pat. No. 5,743,566, which is a continuation-in-part of application No. 08/348,370, Dec. 1, 1994, Pat. No. 5,558,454, which is a continuation-in-part of application No. 08/116,058, Sep. 2, 1993, abandoned.

[51] Int. Cl.[6] ..... B42F 13/00

[52] U.S. Cl. ..... 402/79

[58] Field of Search ..... 402/79, 80 R; 281/38, 2, 5; 283/36–42, 61, 62

[56] References Cited

U.S. PATENT DOCUMENTS

| | | |
|---|---|---|
| 612,078 | 10/1898 | Wickham . |
| 764,701 | 7/1904 | Ayres . |
| 2,007,262 | 7/1935 | Tetlow . |
| 2,037,579 | 4/1936 | Jonas . |
| 3,503,834 | 3/1970 | Schroter . |
| 4,051,285 | 9/1977 | Kramer . |
| 4,127,690 | 11/1978 | Schleifenbaum et al. . |
| 4,243,458 | 1/1981 | Giulie . |
| 4,422,672 | 12/1983 | Levi . |
| 4,430,015 | 2/1984 | Nerlinger . |
| 4,431,325 | 2/1984 | Colby . |
| 4,446,183 | 5/1984 | Savagian . |
| 4,447,481 | 5/1984 | Holmberg et al. . |
| 4,448,443 | 5/1984 | Jones . |
| 4,479,733 | 10/1984 | Segal . |
| 4,528,054 | 7/1985 | Stahl et al. . |
| 4,551,374 | 11/1985 | Holmberg . |
| 4,560,600 | 12/1985 | Yellin et al. . |
| 4,568,108 | 2/1986 | Simpson . |
| 4,615,929 | 10/1986 | Alexander, Jr. . |
| 4,636,179 | 1/1987 | Gentile et al. . |
| 4,643,452 | 2/1987 | Chang . |
| 4,643,455 | 2/1987 | North et al. . |
| 4,662,770 | 5/1987 | Block . |
| 4,773,676 | 9/1988 | Showering . |
| 4,779,897 | 10/1988 | Schall et al. . |
| 4,784,508 | 11/1988 | Shannon . |
| 4,802,692 | 2/1989 | Stryd . |
| 4,803,795 | 2/1989 | Questel et al. . |
| 4,884,826 | 12/1989 | Slagsvol . |
| 4,887,925 | 12/1989 | Groswith, III et al. . |
| 4,910,066 | 3/1990 | Foisie . |
| 4,911,777 | 3/1990 | Truc . |
| 4,952,091 | 8/1990 | Sirko . |
| 4,952,433 | 8/1990 | Tezuka et al. . |
| 4,961,666 | 10/1990 | Pitts et al. . |
| 4,962,603 | 10/1990 | Kao et al. . |
| 4,966,644 | 10/1990 | Clark, Jr. et al. . |

(List continued on next page.)

FOREIGN PATENT DOCUMENTS

| | | |
|---|---|---|
| 57-098082A | 6/1982 | Japan . |
| WO 97/32737 | 9/1997 | WIPO . |

*Primary Examiner*—Willmon Fridie, Jr.
*Attorney, Agent, or Firm*—Oppenheimer Wolff & Donnelly LLP

[57] ABSTRACT

The tabbed edge of a divider sheet has at least one strip releasably attached thereto. The strip helps the printer (or copier) sense the sheet when being fed strip end first or last (landscape direction) into the printer or copier. When fed in the portrait direction, the strip guides the sheet along the feed tray guides thereby preventing skewing of the sheet. After the printer or copier has printed the desired indicia on the tabs and/or body of the sheet, the strip is removed from the sheet and discarded. The strip can be attached to the sheet with adhesive or by a microperforation line.

78 Claims, 9 Drawing Sheets

U.S. PATENT DOCUMENTS

| | | | |
|---|---|---|---|
| 4,990,018 | 2/1991 | Best et al. . | |
| 5,016,370 | 5/1991 | Rhian et al. . | |
| 5,033,899 | 7/1991 | Pitts et al. . | |
| 5,076,490 | 12/1991 | Dulin . | |
| 5,135,261 | 8/1992 | Cusack et al. . | |
| 5,180,461 | 1/1993 | Widmann . | |
| 5,187,888 | 2/1993 | O'Brien et al. . | |
| 5,245,397 | 9/1993 | Mahoney . | |
| 5,299,879 | 4/1994 | Burrow . | |
| 5,340,427 | 8/1994 | Cusack et al. . | |
| 5,401,058 | 3/1995 | Holmberg . | |
| 5,452,062 | 9/1995 | Baldwin et al. . | |
| 5,462,783 | 10/1995 | Esselmann . | |
| 5,466,502 | 11/1995 | Wilkinson et al. . | |
| 5,503,435 | 4/1996 | Kline . | |
| 5,540,513 | 7/1996 | Wyant . | |
| 5,558,454 | 9/1996 | Owen | 402/79 |
| 5,571,587 | 11/1996 | Bishop et al. . | |
| 5,743,566 | 4/1998 | Hunter et al. | 402/79 X |
| 5,836,710 | 11/1998 | Owen . | |

FIG. 6
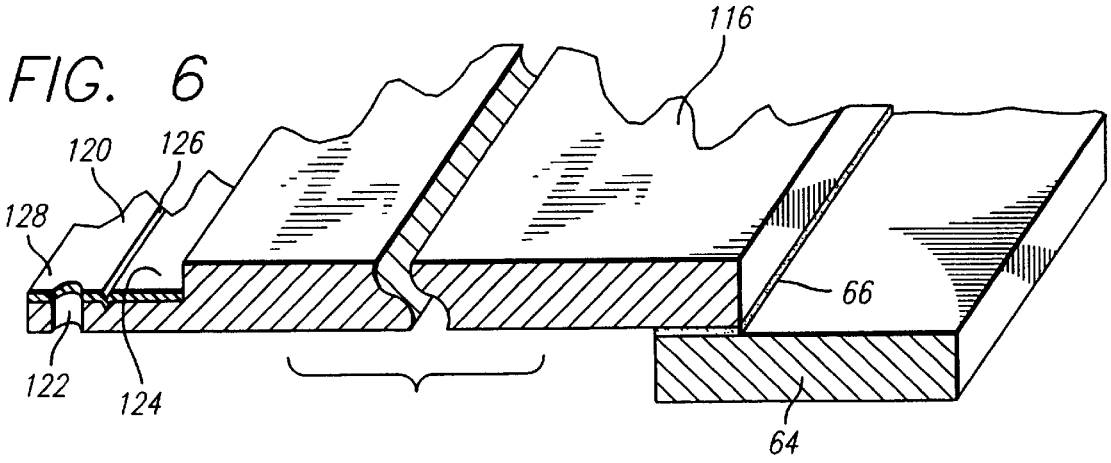
FIG. 8
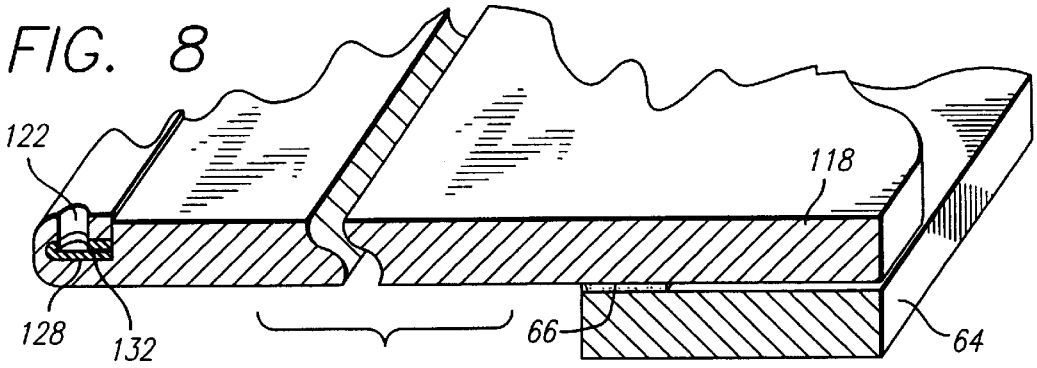
FIG. 9
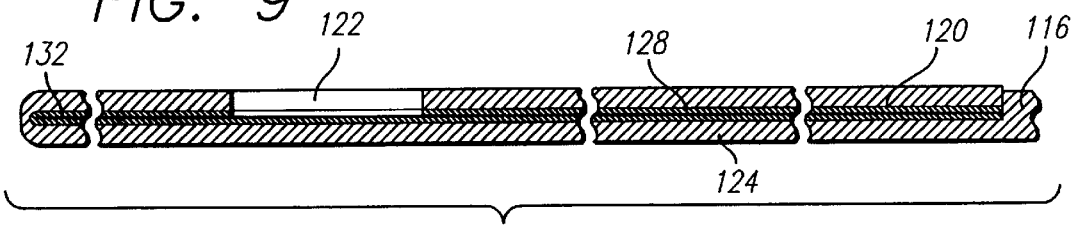
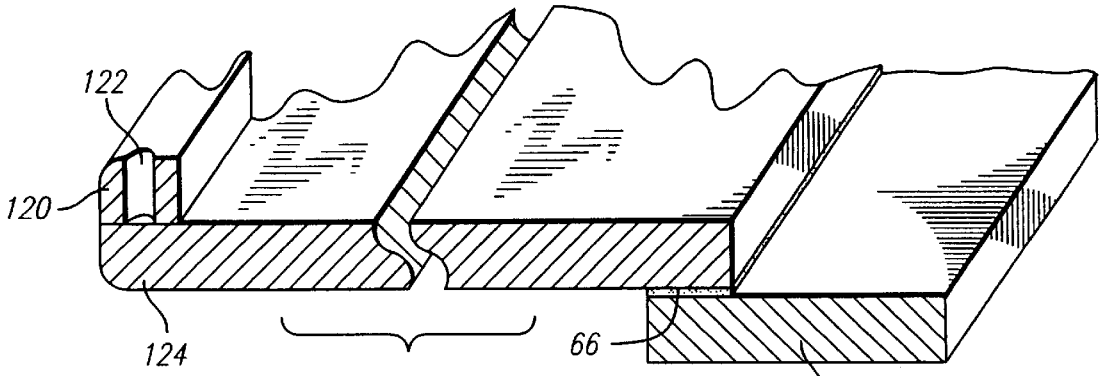
FIG. 10

FIG. 12
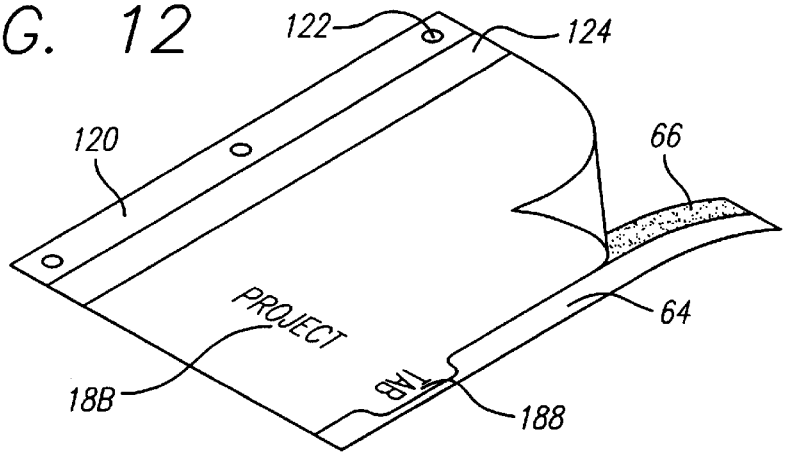
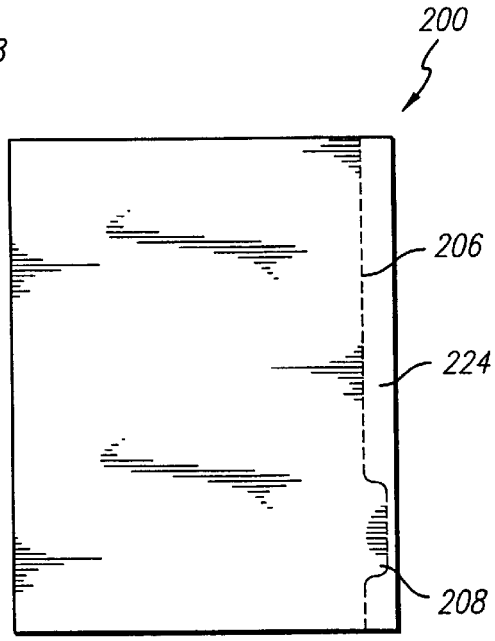
FIG. 13
FIG. 14
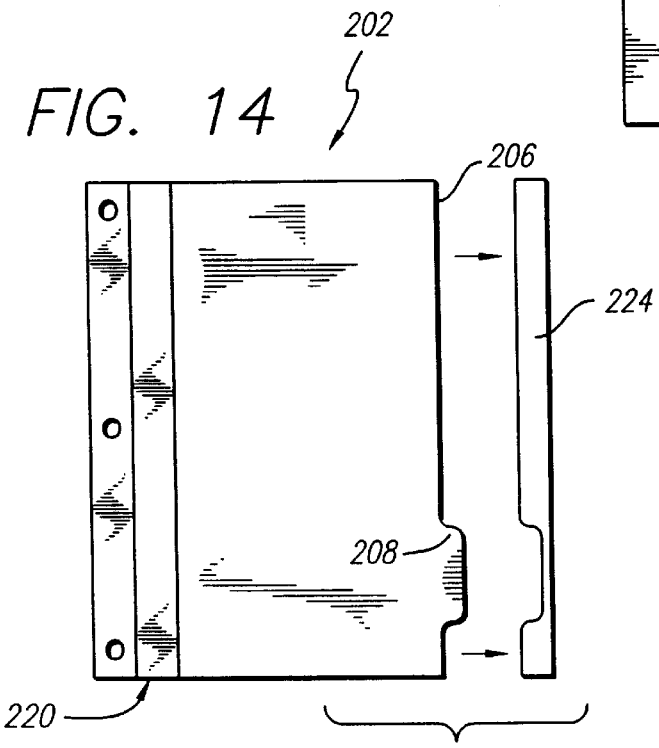

FIG. 17
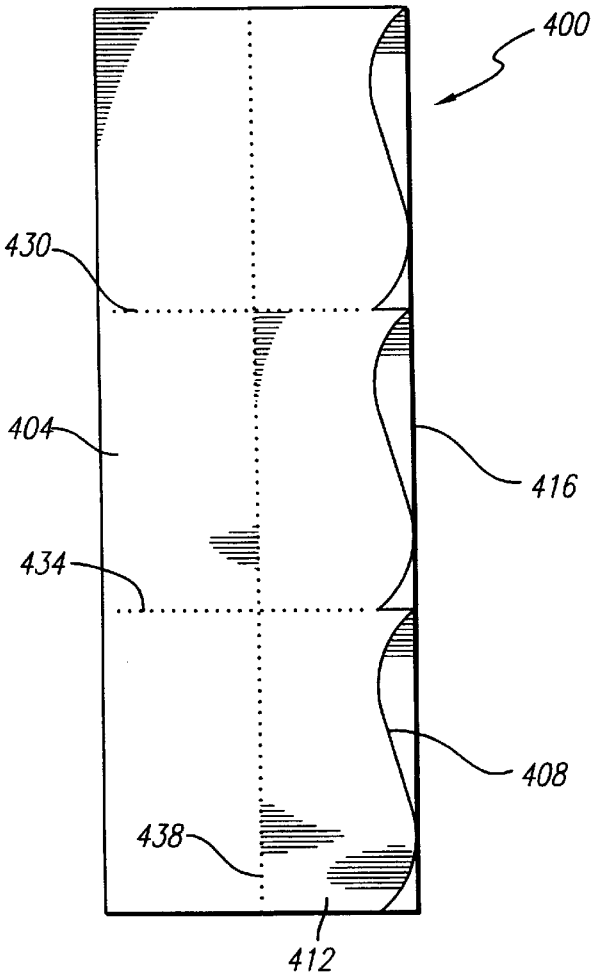
FIG. 19
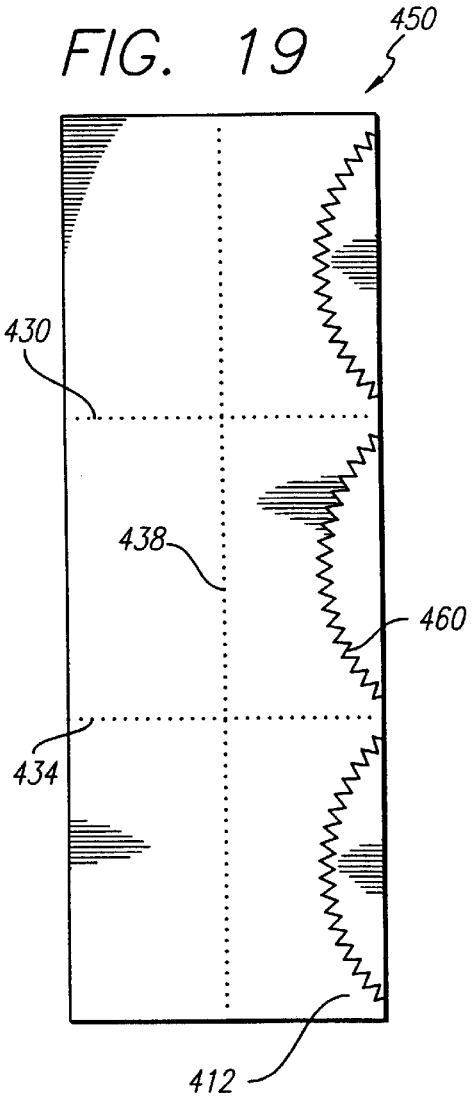
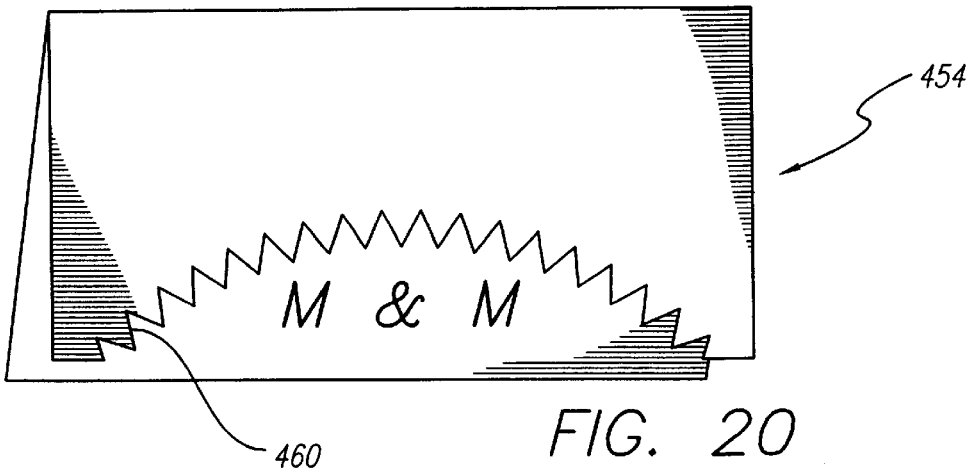
FIG. 20

FIG. 21
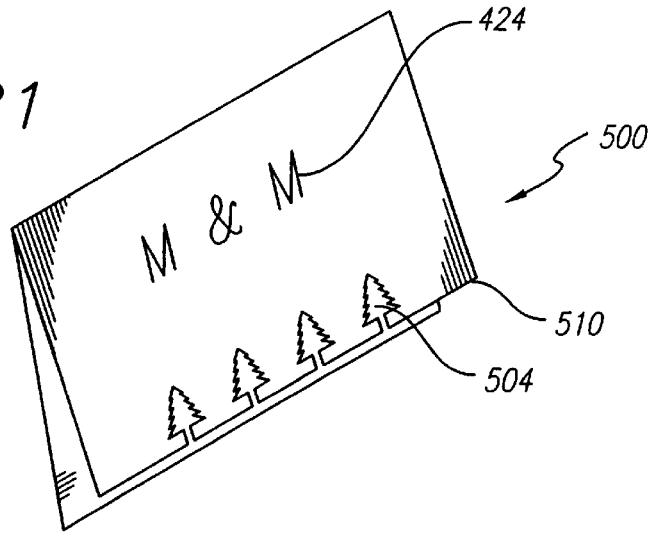
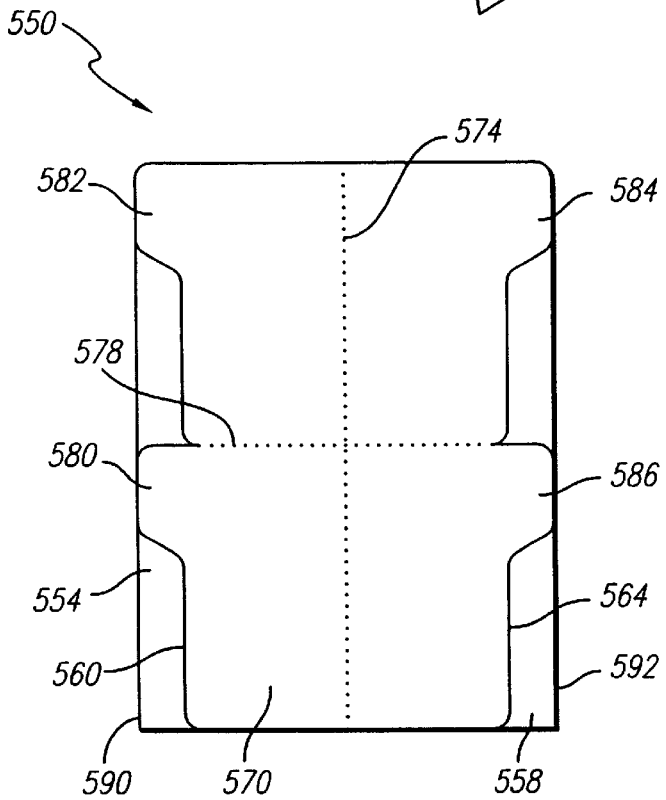
FIG. 22
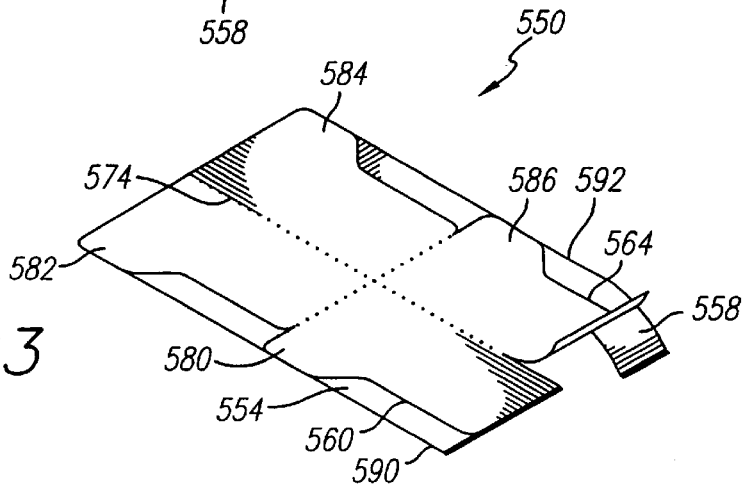
FIG. 23

INDEX DIVIDER SHEET ASSEMBLY AND THE LIKE

CROSS-REFERENCE TO RELATED APPLICATIONS

This is a continuation of application Ser. No. 08/698,710, filed Aug. 16, 1996 now U.S. Pat. No. 5,743,566, which is a continuation-in-part of application Ser. No. 08/348,370 ('370), filed Dec. 1, 1994, now U.S. Pat. No. 5,558,454 which is a continuation-in-part of application Ser. No. 08/116,058 ('058), filed Sep. 2, 1993, now abandoned.

BACKGROUND OF THE INVENTION

This invention relates to tabbed index dividers, business cards, Rolodex® cards, holiday or greeting cards, uneven sheets and the like and particularly those for use in three-ring or similar notebooks. It also concerns methods for printing on them by feeding them through standard laser or ink jet printers, photocopiers or other common printing apparatus.

The width of a standard index tab divider for a three-ring notebook containing sheets of pre-punched 8½ by eleven inch notebook paper is nine by eleven inches, which includes the width of the tab. Unfortunately, many standard laser-jet or ink-jet printers or photocopiers can only accept rectangular sheets of widths not exceeding 8½ inches. Accordingly, there has been a need for an assembly and accompanying method for conveniently printing upon the face and tab portion of a nine by eleven inch divider using a laser or ink-jet printer or photocopier which has an 8½ inch width restriction.

One approach has been to print on a standard 8½ by eleven inch sheet and then adhere a pre-punched spine strip along an edge of the sheet. The sheet can then be inserted into a ringed binder. However, this arrangement is somewhat inconvenient to a user for two reasons. First, for assemblies in which the spine strips are entirely separate from the divider sheets, the user must separately store both components, and storage areas can become cluttered and the spine strips misplaced. Second, the user must very carefully attach the pre-punched spine strip to the divider sheet. If the spine strip is misaligned, the user must reposition the strip or may even need to discard the entire assembly, particularly if a permanent pressure sensitive adhesive is used on the spine. Additionally, this arrangement is somewhat user-unfriendly due to the time it takes to remove a release liner from the spine strip and apply the spine strip to the divider.

Common printers and copiers may have a thickness restriction as well as a width restriction, due to interior clearances and due to the radii of bends in the sheet path through those machines. Uneven thicknesses can cause skewing in the transport of sheets through the printer and possibly jamming. It is therefore important to minimize nonuniformity of thickness over the entire assembly. Holmberg, U.S. Pat. No. 4,447,481 teaches that assemblies for feeding into common printers should have a substantially uniform thickness. (This patent and all other patents, publications and patent applications mentioned anywhere in this disclosure are hereby incorporated by reference in their entireties.)

Different brands of software are currently available and others are being developed for causing laser, ink-jet and other printers to automatically print the desired indicia directly on tabs of dividers. The dividers can be approximately 8¼ inches by eleven inches when folded before printing and unfold the standard nine inches by eleven inches after printing, as described in the above-mentioned '370 application. They are typically constructed of medium weight paper reinforced along one longitudinal edge by an adhered layer of plastic film. This edge may include three through-holes or apertures for filing the divider in a ring binder. Extending out from the opposite edge is a tab, having a length of about 1¼ inch to 1⅞ inch (or 1⅛ inch to 3¼ inches) and a width of one-half inch and which may be reinforced with an adhered layer of plastic film. The tabs on different dividers in a set are typically provided at between three to eight different positions.

In the past when such dividers were fed (in the portrait direction of the divider sheet) using multipurpose or cassette trays into ink-jet, electrophotographic or laser printers, the dividers tended to skew as they entered the printer. This skewing occurs because (1) the tabs of the dividers stick out one-half inch from the body of the paper and thus do not provide full continuous contact of each divider to the paper guide of the (multipurpose) printer tray and (2) the paper guide of the multipurpose tray is much shorter than the paper divider itself. This, means that the dividers with the last few tab positions do not contact the paper guide, specifically, the fourth and fifth tabs of a five tab set and the fifth through eighth tabs of an eight tab set.

Even when an insert feed tray as described in copending U.S. application Ser. No. 08/511,879 ('879), filed Aug. 4, 1995, is used, a perfectly straight feed in the portrait direction may not result. In fact, that insert feed tray works perfectly with only about one half of the printers. For example, it does not work well with vertical feed trays and with the older HPII and HPIII printers where the insert tray tends to move around a bit causing shifting of the print and skewing. The tray tends to move around when it is only 8¼ inches wide and the cassette tray is 8½ inches. A two-sided insert tray works better in that situation.

Within the past year a new office printer—the Hewlett Packard 4V printer—has been made available. The HP4V printer is a high speed, network shared printer adapted for office use. Unlike prior printers, except a few used in the graphic arts business for large format printing, the HP4V printer handles sheets as wide as eleven inches. It thus allows 8½ by eleven inch sheets to be fed therein in the landscape direction. Thus, 8½ by eleven inch tabbed divider sheets can be fed in tabbed edge or binding edge first. And the available software allows the printer to print both along the tab and across the body of the sheet in a single pass through the printer.

A problem, however, is that unless the tab of the sheet happens to be aligned with the printer's start-of-the-page sensor, the sheet, if fed in tab edge first (or sheet edge first with a trailing tab), will not be detected or sensed and will not be fed into the printer for a printing operation thereon. More accurately, the tab will not be sensed and printing on the tab does not occur. The HP4V printer has center sensors to sense the beginning and trailing edges of the paper. Thus, for the HP4V printer when a five-position tabbed divider system is used, only the dividers with their tabs in the third position will be sensed for printing on the tabs when fed in tab edge first (or as a divider with a third-position trailing tab). That is, those dividers whose tabs are in the first, second, fourth and fifth positions do not cause the tabs to be sensed for printing thereon. Thus, the divider must be fed in a hole punched side first, on the side opposite the tab. Also, if the dividers are fed in binding (hole punched) edge first, all of the sheets are fed through, but only the ones with the tabs near the center would be printed. That is, for sheets having uncentered tabs, the printer will not sense the trailing edge and print on the tab.

SUMMARY OF THE INVENTION

Directed to remedying the problems in and limitations of the prior art, disclosed herein are improved systems for feeding tabbed index divider sheets (and the like) into printers for printing thereon. The tabbed divider sheet is provided with a removable strip attached to the sheet extending a slight distance beyond the tabbed edge thereof and extending the length of that edge (to 11 inches). Thus, with the sheet in the feed tray of the new wide format printers, disposed in the landscape direction and the tabbed edge being the leading edge, the removable strip is detected by the sensor. Since the strip extends the entire sheet length, the sheet is thereby detected no matter where the tab is positioned on the sheet. That is, the detector detects the leading edge strip itself and not the smaller usually offset tabs. If that sheet is fed in the portrait direction into a printer, the strip advantageously guides the sheet along the tray guide edges, without skewing, into the printer.

After the sheet has been fed (in either the landscape or portrait directions) into the printer, printed thereon and expelled or ejected, the strip is removed from the sheet. With the strip removed, the (backside of the) tab is exposed or defined and the sheet is ready for use. The strip was attached to the sheet using removable adhesive or microperforations, for example. Thereby the strip can be subsequently removed easily and cleanly by peeling or tearing it off from the divider sheet.

In other words, a peel off strip is releasably attached to the leading (tabbed) edge of the divider sheet to provide a sheet edge to engage the start-of-the-page detector of the printer and permit imaging on the tab area. Conversely, a peel off strip is releasably attached to the trailing (tabbed) edge of the divider to provide a trailing sheet edge to engage the sheet detector allowing imaging of the tab. The strip is temporarily fixed to the divider page with a removable adhesive and can be constructed of a lighter weight paper than that of the divider sheet or every of plastic. Another advantage of this design is that it overcomes the non-printing "dead zone" at the leading edge of the sheet by providing early engagement of the sensor. Thereby, images can be placed right up to edge of the tab. A further advantage is that rotation of the tab indicia is not necessary since it can be treated as ordinary text in conventional word-processing software applications. Alternatively, the peel off strip can be constructed as two separate peel off strips or strip portions releasably attached to the tabbed edge and positioned on opposite sides of the tab. Both tabs contact only the adjacent ends of the tab and neither extends across it. Thereby, the printer can print alternatively on either side or on both sides of the tab as desired.

The peel-off or microperforated strip is also advantageous in that the divider sheet is then squared off on the tab side and is thus not odd shaped. It would also create a sheet having a width of 8½ inches, instead of 8¼ inches. This makes it possible to feed the dividers into virtually any laser printer with straight-path cassette feed, with top load or center feed trays, or inkjet printers or photocopiers without skewing, and not just side feed laser printers that have multipurpose trays.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 6 is an enlarged cross-sectional view taken on line 6—6 of FIG. 5;

FIG. 8 is an enlarged cross-sectional view taken on line 8—8 of FIG. 7;

FIG. 9 is an enlarged cross-sectional view taken on line 9—9 of FIG. 7;

FIG. 10 is a view similar to FIG. 8 of a third index divider sheet assembly of the invention;

FIG. 12 is a perspective view of the second assembly of FIG. 7 after printing thereon by the printer of FIG. 11 and showing the folded edge unfolded and the strip being removed;

FIG. 13 is a front elevational view of a fourth index divider sheet assembly of the invention;

FIG. 14 is a front elevational view of a fifth index divider sheet assembly showing the perforated strip thereof being removed;

FIG. 17 is a plan view of a business card sheet assembly of the present invention;

FIG. 19 is a plan view of an alternative business card sheet assembly of the present invention;

FIG. 20 is a perspective view of one of the business cards of the assembly of FIG. 19 in a generally finished condition;

FIG. 21 is a perspective view similar to FIG. 20 of a holiday card of the present invention;

FIG. 22 is a plan view of a tabbed flip file (Rolodex®-type) card sheet assembly of the present invention; and FIG. 23 is a perspective view of the assembly of FIG. 22 after having passed through a printer or copier and showing a subsequent separation procedure.

DETAILED DESCRIPTION OF PREFERRED EMBODIMENTS OF THE INVENTION

Figure 1:
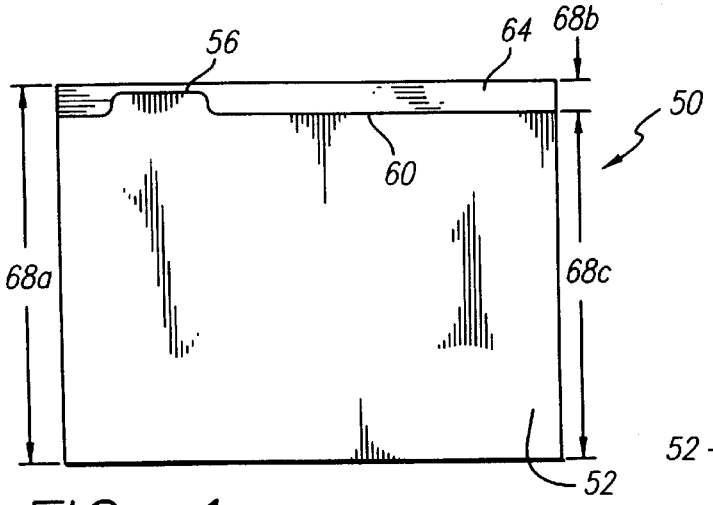
FIG. 1 is a front elevational view of a first index divider sheet assembly of the present invention.

Referring to the drawings, a number of embodiments of the present invention are illustrated. A first preferred embodiment is shown in FIGS. 1–4, and this embodiment or index divider sheet assembly is shown generally at 50. The assembly 50 includes an index divider sheet 52, as shown in isolation in FIG. 4 and having a length of eleven inches and a width up to the straight edge of eight-and-a-half (or eight and a quarter) inches and a total width dimension including the tab 56 of nine inches. The assembly 50 can also be standard A4 paper, which is 8.27 inches by 11.69 inches not including the tabs. The sheet 52 is preferably a fifty-seven pound vellum bristol, approximately 7.5 mil thick, such as that available from Wausau or Champion, or ninety pound index paper, approximately seven mil thick, such as that available from International Paper. The tab 56 itself has length dimensions for laser dividers of 1⅛ inch to 1¼ inch for an eight tab system, or for a five tab system of 1¾ to two inches, and one-half inch width. (The tab length is measured at one half the height or width of the tab.) The divider sheets 52 are typically provided in a set wherein the tabs (56) are positioned at three, five, eight or ten different locations (⅓, ⅕, ⅛ and 1/10 cuts, respectively) along the edge 60. Thus, when the sheets are in a ring binder or other file (not shown), the tabs (56) of adjacent sheets (52) will be off-set from each other to facilitate reading of any indicia thereon and also for accessing the tab to open the file to the desired location, as is known.

Attached to the sheet 52 along the edge 60 thereof is a strip of paper 64. The strip 64 would typically have a length the same as the length of the divider sheet 52 and would have a width dimension of between ¾ and one and a half inches and with a minimum attachment of ⅛ to ¼ inch. The strip 64 can be twenty-four pound bond paper or equivalent film, and have a thickness of approximately 3½ to four mil. The strip 64 is preferably thin, thinner than the index divider sheet 52, so that the strip plus the sheet are together not too thick to pass through the printer.

Figure 3:
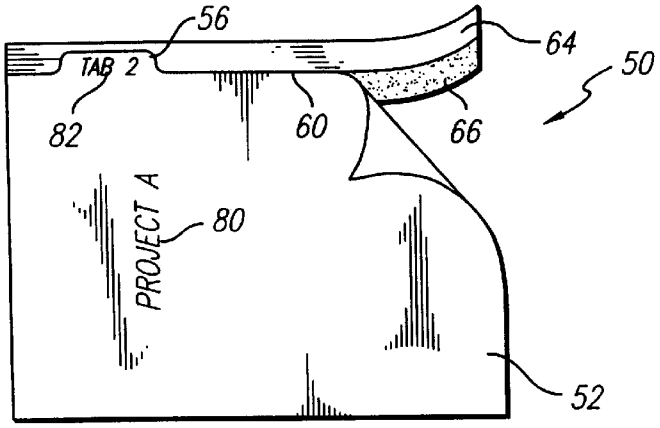
FIG. 3 is a view of the assembly of FIG. 1 after having passed through the printer of FIG. 2 and showing the strip being removed.

The strip 64 is glued to the back of the divider sheet 52 along the edge 60. Referring to FIG. 3, the adhesive or glue 66 is preferably a removable pressure sensitive type of adhesive, but can also be a fugitive type of adhesive. An example thereof is the 48341 (formerly 45858) or 42995 Aqueous Fugitive Adhesive from Swift Adhesives, Division of Reichhold Chemicals, Inc. of Research Triangle Park, N.C., as described in detail later. The adhesive 66 is deposited on one half of the length of the strip 64. Then the strip 64 and the sheet 52 are positioned and laminated together. If a pressure sensitive adhesive 66 is used, only minimal laminating pressure is needed. The back of the tab 56 can be, but is preferably not, directly glued to the strip 64.

When glued, the strip 64 extends preferably ½ to ¾ inch (½ inch for print-on tabs and/or laser divider and ¾ inch for laser divider) outward beyond the edge 60 of the divider sheet 52, and 0–¼ inch beyond the outer edge of the tab 56. This gives the assembly 50 an overall width of preferably nine inches (when laser dividers are unfolded), or 8¼ to 8½ inches for laser divider (when folded) and nine inches for print-on tabs, respectively. In other words and referring to FIG. 1, dimensions 68*a*, 68*b* and 68*c* can be 8½, ½ (or ¾) and 7¾ inches, respectively, for laser dividers.

Figure 2A:
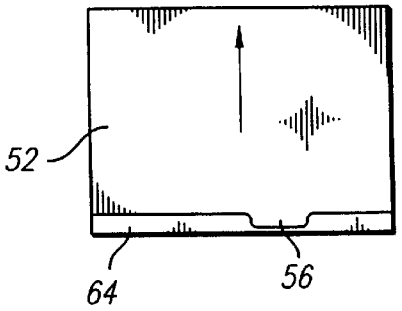
FIG. 2*a* shows the assembly of FIG. 2 with an alternative binding edge first, landscape feed direction into the printer as indicated; it is also within the scope of the invention for the assembly of FIG. 2 to be fed into the printer in a landscape feed direction with the binding edge last, that is, with the direction of the arrow of FIG. 2*a* reversed.
Figure 2B:
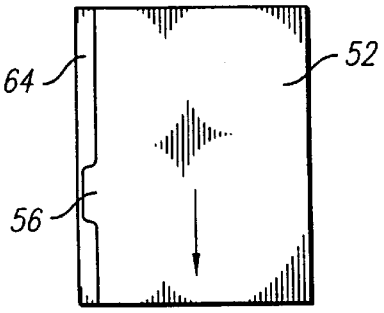
FIG. 2*b* is a view similar to FIG. 2*a* showing an alternative portrait feed direction of the invention.
Figure 2:
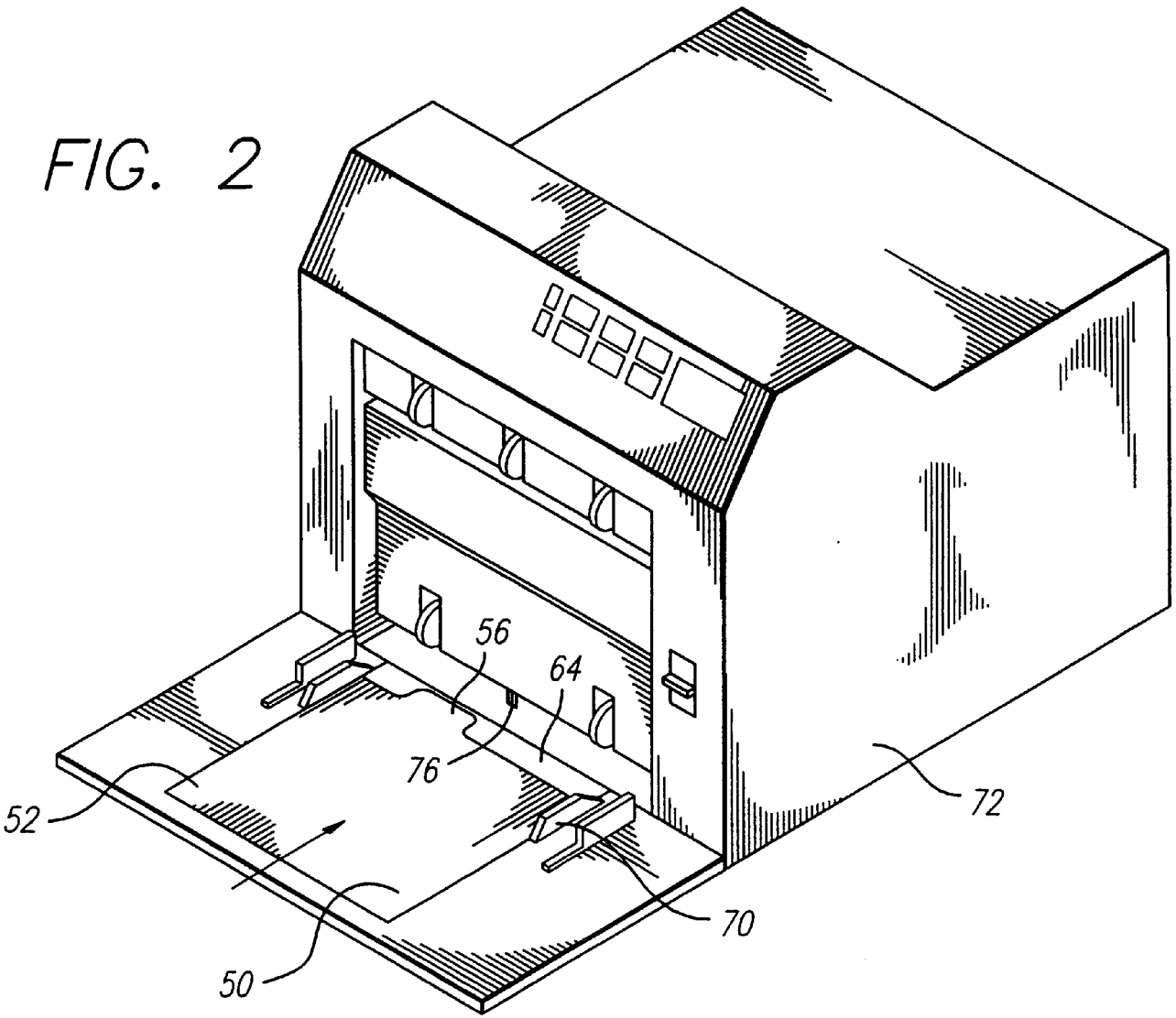
FIG. 2 is a perspective view of the assembly of FIG. 1 shown in position in a feed tray of a printer for feeding in a landscape tab edge first direction into the printer.

Thereby, and referring to FIGS. 1 and 2, the divider sheet assembly 50 is positioned in the feed tray 70 of the printer 72. As shown in FIG. 2, the printer 72 can be the HP4V printer, a wide format printer as previously described. The printer 72 can also be a copier, such as a digital programmable copier, like the Xerox Docutech™ copier. And the assembly 50 can be deposited in the feed tray 70 in the landscape feed direction as shown. As previously mentioned, the wide format printers allow for feeding of documents which are eleven inches wide into the printer (72). Alternative feed directions of this invention are illustrated by the arrows in FIGS. 2*a* and 2*b*.

When the printing cycle is initiated the sensor 76 of the printer 72 shown in the center detects the paper strip 64 and thereby the presence of the divider assembly 50 and initiates the feeding and printing cycle. Since the detector or sensor 76 is in the center of the eleven inch feed of the printer 72, it would not have detected the divider sheet 52 without the strip 64 because the tab 56 is off-set from the detector or sensor 76, and thus imaging would have been interrupted. In other words, if the detector does not sense the start of the page until the main body of the divider has reached it, no image is deposited on the tab. (Examples of detectors are finger types and photosensors. The sensor engages interlocking electronics that tell the printer that paper is coming in (is inbound) and thus printing may proceed or outbound so printing will stop.) The same is true if the divider is fed in binding edge first without the paper strip; the printer would not detect the trailing edge of the sheet without the additional paper strip.

With the divider sheet assembly 50 fed into the printer 72 and the printing operation conducted as directed by the printer software, the desired indicia is printed on the divider sheet 52. This can be, for example, as shown in FIG. 3 with a title 80 width-wise of the divider sheet 52 and another indicia title (either horizontal or vertical) 82 along the length of the tab 56. Thus, assembly 50 allows direct printing without the use of macros or special commercial graphics software.

Figure 4:
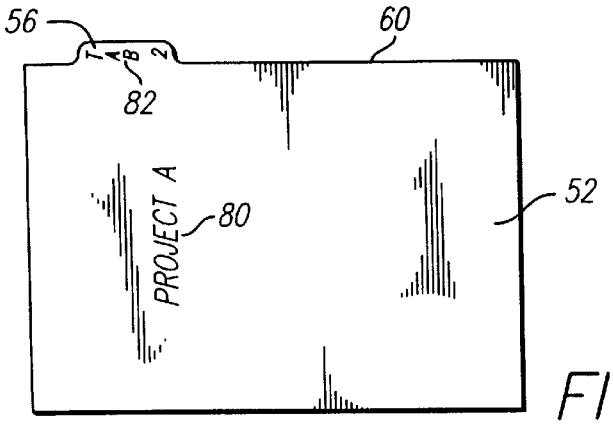
FIG. 4 is a view of the assembly of FIG. 3 with the strip completely removed and disposed of and showing an alternative tab printing alignment.

With the printing on the divider sheet 52 completed, the divider sheet assembly 50 is expelled or ejected from the printer 72 in a conventional manner. The user then removes the strip 64 from the divider sheet 52. As shown in FIG. 3, this is a simple process of peeling it off to release the adhesive 66. No residue of the adhesive 66 remains on the divider sheet 52 because of the type of adhesive selected. The divider sheet 52 is then ready for use as shown in FIG. 4. This can be used in a file folder, stapled or otherwise hole punched or unfolded to reveal hole punches (for Laser divider) and put into a binder. Alternatively, apertured spines can be attached as described earlier in this disclosure.

One preferred method of constructing and using the divider sheet (52) is to provide the binding edge, the edge opposite of the tabbed edge (60), with a plurality (preferably three) of preformed spaced apertures or through-holes for fitting the divider sheet into a conventional three ring binder. The binding edge can be constructed as described in the '370 application and as is illustrated in FIGS. 5–9, for example, and discussed below.

Figure 5:
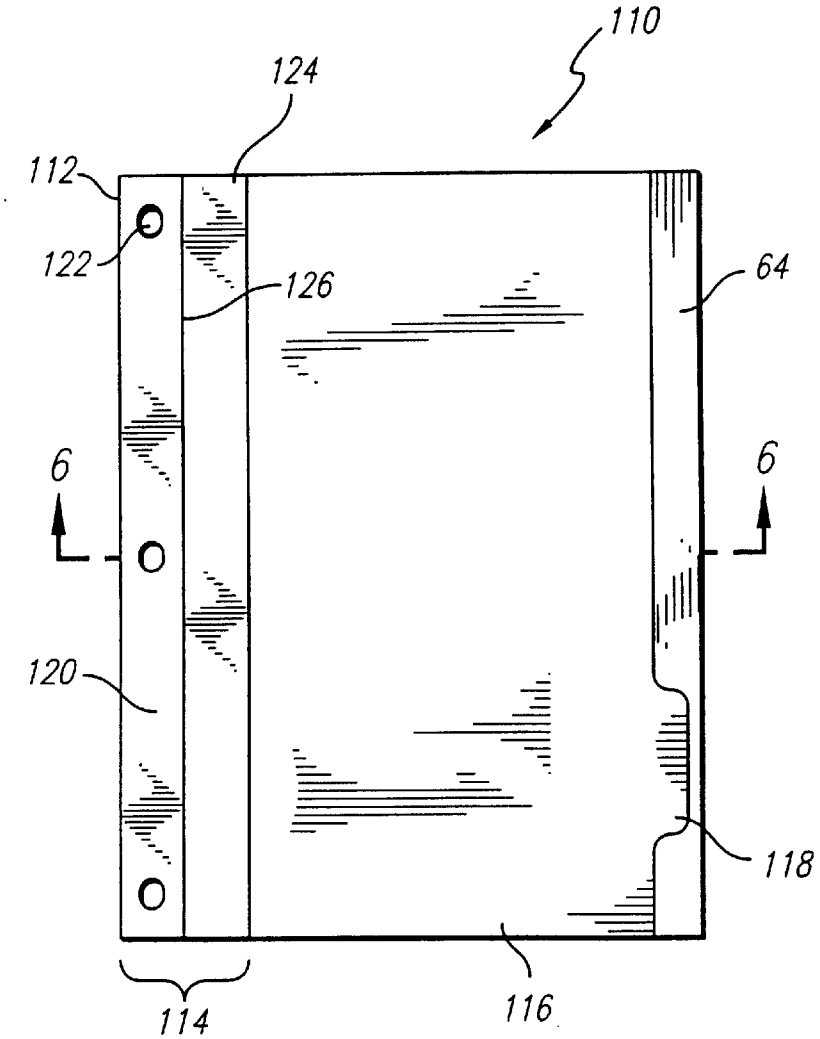
FIG. 5 is a front elevational view of a second index divider sheet assembly of the invention.
Figure 11:
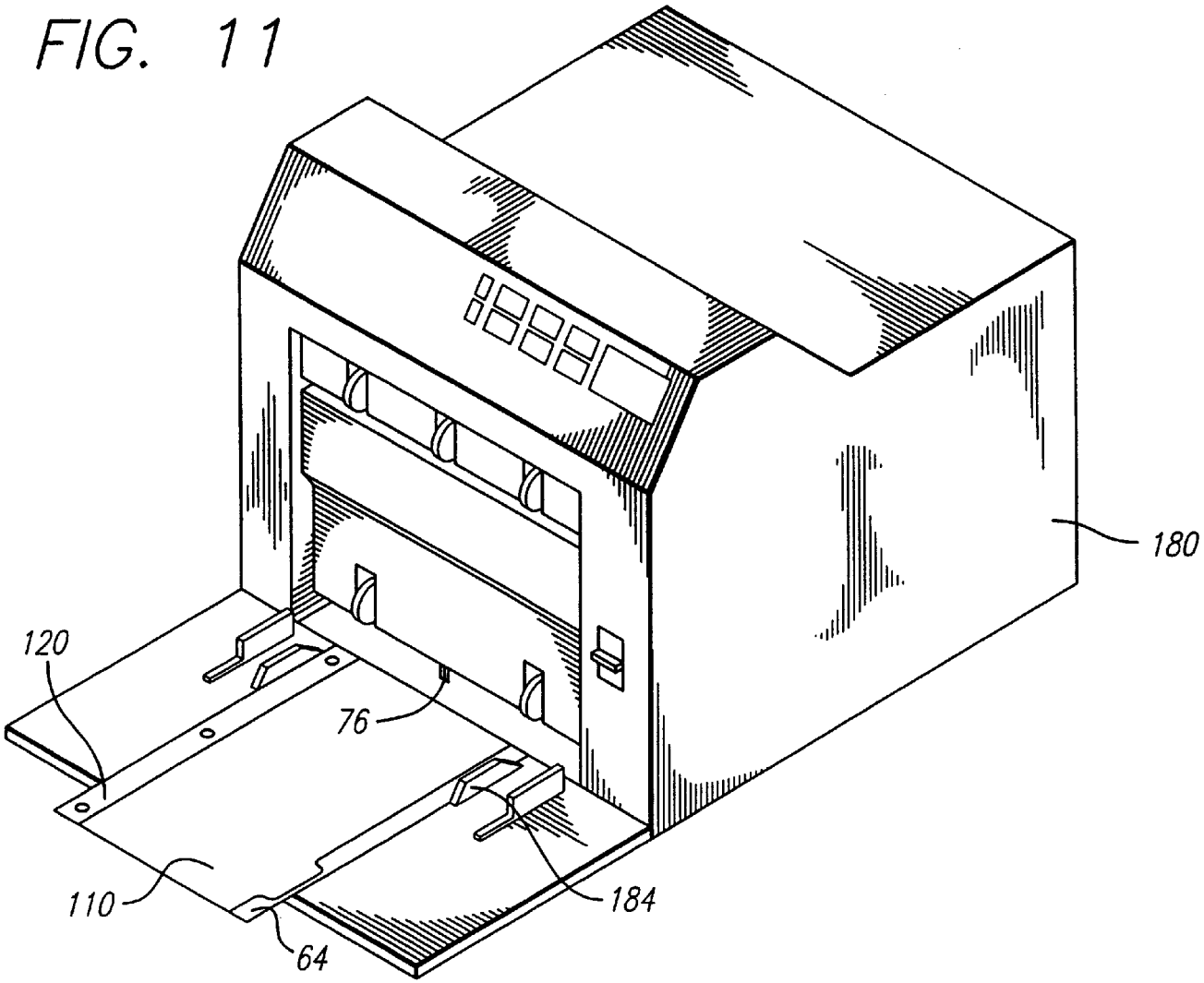
FIG. 11 is a view similar to that of FIG. 2 showing the second assembly of FIG. 7 in a printer feed tray for feeding in a portrait direction into the printer.

FIG. 5 illustrates a one-piece divider assembly 110 which can be folded over at the binding edge thereof and which includes the previously-mentioned adhesive strip 64. The assembly 110 is suitable for printing in laser printers, ink-jet printers, photocopiers and other printers such as shown in FIGS. 2 and 11. The assembly 110 has a binding edge 112 and an integral, debossed binding edge region 114 extending inwardly into the sheet from the binding edge. The assembly also has a main body 116 with an integral, outwardly extending tab 118. A heavy paper or cardstock sheet forms the structural basis for the entire divider assembly 110.

The binding edge region 114 has a folding portion 120 which has spaced ring apertures 122. The binding edge region 114 may also have a non-folding portion 124. The folding portion 120 and non-folding portion 124 are separated by a folding line 126, about which the folding portion may fold. Longitudinal folding line 126 is inset from and runs parallel to the binding edge 112. In the embodiment of FIG. 5, the folding line 126 is scored to improve the regularity and proper positioning of the fold. Such scoring may consist of notches, cuts or a single indented line as best shown in FIG. 6.

FIG. 6, which is an enlarged sectional view taken on line 6—6 of FIG. 5, shows that the folding portion 120 and the non-folding portion 124 of binding edge region 114 are debossed or calendered. That is, binding edge region 114 is reduced in thickness somewhat relative to the main body portion 116. Binding edge region 114 is also laminated with a reinforcement film 128 which is adhered to one surface of the binding edge region. FIG. 6 further shows that folding line 126 is a line of indentation which extends into the divider sheet.

The tab 118 can be reinforced with a tab reinforcement film which is adhered to both sides thereof. In this instance, the tab reinforcement film is an adhesively-coated, symmetrical member that is folded about and adhered to the tab 118 at a line of symmetry of the reinforcement film member. The adhesive for the tab reinforcement film should be stable to temperatures of up to four hundred and fifty degrees Fahrenheit so as to remain stable in the high heat environment of a laser printer or photocopier.

Figure 7:
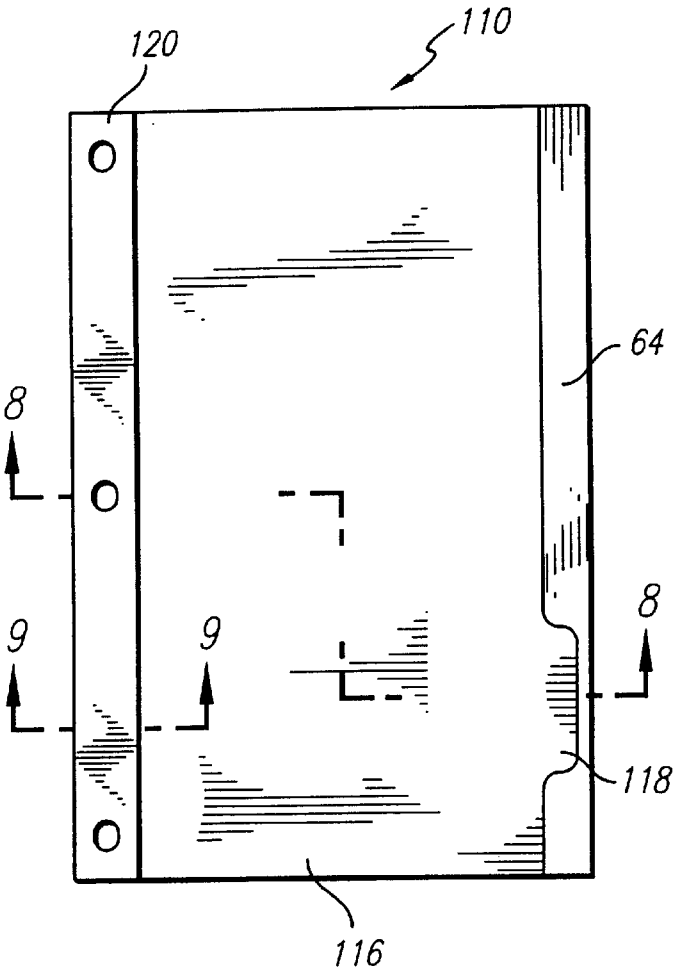
FIG. 7 is a view similar to FIG. 5 of the second assembly in a folded over position.

FIG. 7 illustrates the assembly of FIG. 5 with folding portion (or folding flap) 120 having been folded over and adhesively tacked to non-folding portion 124. In this configuration, the assembly 110 is ready to be fed into a laser printer, ink-jet printer or photocopier. The printer will print onto the tab 118 and/or the main body portion 116. The tab reinforcement film may be provided with a laser printable coating which will receive indicia from a variety of different printers.

FIG. 8 is an enlarged sectional view taken on line 8—8 of FIG. 7. It shows the folding portion 120 folded over at score line 126 and tacked with a single-use adhesive layer 132 to non-folding portion 124. The single-use adhesive layer 132 temporarily maintains folding portion 120 in the folded position of FIG. 8 so that the assembly 110 will pass through the printer without jamming. In this folded configuration, the assembly 110 is substantially flat and has a width of 8¼ inches as measured from the edge of the folded portion to the very edge of the index tab. The main body sheet may have a slightly reduced thickness at tab 118 to help compensate for the added thickness of the tab reinforcement film, and the thickness reduction may be accomplished using a standard calendering process.

FIG. 9 is an enlarged sectional view of the binding edge region taken on line 9—9 of FIG. 7. It shows that the debossing has reduced the thickness of the binding edge region such that when folding portion 120 is folded over, the total thickness of the folded-over portion is approximately the same as the thickness of the main body of the sheet (For Laser dividers when folded over the total thickness of the folded portion is not the same thickness as the body. It is approximately 12.5 mil versus 7.5 mil for the body portion. If the binding edge is not calendered, the thickness would be 17.5 mil.) Various embodiments of the present invention may have a greater or lesser degree of debossing. The general idea is to prevent the folded-over binding edge region from bulging upward to any substantial extent, thereby causing jamming in the printer (72). However, the thickness of the folded-over portion may be slightly greater than the thickness of the main body.

The following materials and dimensions are provided for purposes of illustration but not of limitation. The assembly 110 may be made from a single sheet of paper stock which is approximately 6.5 to 8.0 mil thick and nine inches wide. One suitable type of paper stock is available from the Champion Paper Company in a basis weight of fifty-seven pounds per one thousand eight hundred square feet. Various laser printable cardstocks and papers of various thickness are also acceptable.

A suitable adhesive (132) for tacking down the folding portion 120 to the non-folding portion 124 is the 48341 (formerly 45858) or 45992 Aqueous Fugitive Adhesive available from Swift Adhesives Division of Reichhold Chemicals, Inc. of Research Triangle Park, N.C. When wet, this adhesive creates a good paper-to-paper bond. However, when it dries, the bond will still hold until it is physically broken. Once the adhesive bond is broken, as for instance after a user has unfolded the folding portion 120 from the non-folding portion 124 and broken the adhesive seal, the dry adhesive is no longer tacky and will not stick to anything. When dry and tackless, the adhesive is virtually unnoticeable.

The edge reinforcing film, which serves to reinforce the hole punches 122, may be a 0.5 to 1.0 or 2.0 mil thick strip of clear polyester film, coated on one side with a thermally-activated adhesive which remains stable at temperatures of between three hundred and seventy-five to four hundred and fifty degrees Fahrenheit that may be generated within a laser printer. Such a film and suitable adhesive are available from Protect-All, Inc. of Darien, Wis. The tab reinforcing film, based on 0.5 to 1.0 or 2.0 mil polyester film, is coated on one side with a stable heat-activated adhesive for attachment to the tab portion of the divider sheet and on the other side with a coating that enhances laser, ink-jet or copier printability. One such coating is available from Precision Coatings, Inc. of Walled Lake, Mich.

A number of companies have performed the process of bonding these reinforcing film to index dividers, and the process is well known. One such company is Avery Dennison Specialty Products Division of Rolling Meadows, Ill. In the embodiment illustrated in the drawings, the edge reinforcing adhesive coating is approximately 0.5 mil thick and the tab adhesive coating is approximately one mil thick, although thicker or thinner coats may be used as desired.

It is noted that both the edge and tab reinforcing films should also be stable in the high temperature environment of today's laser printers. Consequently, the reinforcement films, coatings and adhesives should be temperature stable up to temperatures of approximately four hundred and fifty degrees Fahrenheit. However, if printers are developed that do not generate such temperatures, this requirement may be relaxed.

With respect to dimensions, in its unfolded position, the assembly 110 may be eleven inches long by nine inches wide as measured from the binding edge 112 to the outermost edge of the tab 118. Tab 118 may extend one-half inch outwardly of the main body 116 and may have various lengths for various purposes, with common lengths being 3¼ inches for a three-tab set 1⅞ inches for a five-tab set and 1¼ inches for an eight-tab set.

Folding portion 120 may be ¾ inch wide so that, in the folded configuration, the assembly is eleven inches long by 8¼ inches wide as measured from the folded edge to the outermost edge of the tab 118. An advantage of having a folded divider width of 8¼ inches relates to a limitation of some printers which are unable to print within ½ inch of the edges of an 8½ inch wide sheet. This would prevent printing on a tab that extends only ½ inch. A ¼ inch offset, possible with the narrower sheet, effectively reduces this unprintable zone by ¼ inch, allowing printing on half of the tab. By increasing the width of the folded portion to one inch, the folded divider width decreases to eight inches, allowing printing over the full extent of the tab 118. Thus, increasing the width of the folded portion 120 increases the printable area of the tab 118.

Another consideration in choosing the width of the folding portion 120 is the need to avoid intersecting the holes 122, which extend to a distance of about ¼ inch from the binding edge. That is, the folding line 126 should be inset toward the main body from the inner edge of the holes 122. With all of the aforementioned considerations in mind, a practical range for the inset of the score line 126 is between about ⅝ inch and one inch from the binding edge 112.

The hole-reinforcing film 128 (FIG. 6) may cover an area which includes the score line 126 and which strengthens the assembly 110 against tearing along the score line and also enhances the appearance of the product following unfolding.

The binding edge 114 can be reduced in thickness compared to the main body of the divider sheet. This may be achieved by compression of the sheet, referred to as debossing or calendering. Processes for debossing papers and cardstocks, which typically utilize calendering devices having a calendering cylinder and an anvil roll between which the sheet is fed, are well known in the art. Ideally, the thickness reduction would be more than 50% of the original sheet thickness so that the reinforced and folded-over thickness would equal that of the original sheet.

The difficulty of increasing the density of paper beyond the density of the constituent fibers, however, limits the thickness reduction for a 6.5–8.0 mil sheet to less than about 1.5–2.5 mils. This yields, after reinforcing and folding, a thickness on the folded edge in the neighborhood often to thirteen mils. While not perfectly coplanar, such sheets will reliably run through common laser and inkjet printers. If a higher degree of coplanarity is desired, an alternative method of creating a thickness step at the binding edge may be employed in which the body of the divider sheet is constructed as a laminate totalling less than ten mils in thickness over the main body of the sheet, and a partial laminate totalling less than about five mils in the binding edge region.

In the embodiments shown, both the edge reinforcing film and the calendering or debossing are done on the top side of the divider. However, the debossing can be done on the back side of the divider, and the edge reinforcing film can be provided on the back side as well. By putting the reinforcing film on the backside of the assembly, there is film-to-film lamination when flap or folding portion 120 is folded over onto non-folding portion 124. This may be desirable in some embodiments.

A further example of this invention (which is not illustrated in the drawings) is an alternative, laminated two-ply embodiment having a lower sheet and an upper sheet that is permanently adhered to the lower sheet. As with the previous embodiments, this embodiment includes a binding edge region, which, however, is an extension of the lower sheet and is not normally debossed. The upper sheet is somewhat narrower than the lower sheet, so that the upper sheet does not cover binding edge region. The tab extends outwardly from the main body of the divider, and is reinforced with polyester tab reinforcement film.

The upper and lower sheets are typically bonded together with an adhesive that is stable against flow and degradation at the high temperatures encountered in laser printers and copiers. One suitable adhesive for laminating the two sheets together is Nicomelt L-2274, manufactured by Malcom Nicol & Co. Other hot melt adhesives may also be used, such as that sold by Bostik under the trade identification Bostik 4101.

Binding edge region (114) includes a folding portion (120), a scored folding line (126) and a non-folding portion (124). Like the embodiment of FIGS. 5–9, the manufacturer provides the embodiment to the end user with the folding portion folded over and adhered with a single-use adhesive to the non-folding portion.

The upper and lower sheets are typically each approximately three to four mils thick and are made of sheet paper. Alternatively, the upper sheet and/or lower sheet may be made of polyester or other plastic. With at least one of the sheets being a strong plastic sheet, there is less of a need to provide the binding edge reinforcement film that is required for all-paper embodiments. Preferably, the sheets are both made of the same material so that the divider will not be prone to curling when subjected to changing humidity conditions.

With the lower and upper sheets having approximately the same thickness, the divider has a substantially uniform thickness across the folded-over binding edge region and the main body of the divider. That is, there is no sudden increase in thickness at the juncture of the folded-over portion and the main body, as there typically is in the one-sheet embodiment shown in FIG. 8. Thus, by way of example and not of limitation, any of a variety of materials may be used. For example, thinner or thicker paper material may be used for the main sheet portion of the laser printable index divider. Tab 118 is generally integral to the main sheet 116. However, index tab 118 may be a separate component that is simply adhered to an edge of the assembly. Index tab 118 is shown in the drawings as being on the right hand side of the assembly. However, the tab 118 may be on other sides of the assembly, such as on the top or bottom thereof.

The binding edge reinforcement 128 may extend the entire width and length of the assembly. Alternatively, a second binding edge reinforcement layer may be provided on the backside of the sheet.

Tab sheet assemblies of various dimensions may also be provided. For example, some binders are only five inches wide by ten inches long. Dividers may be sized appropriately for use in such binders, or may be sized to meet the size requirements of any of a variety of other binders. Additionally, the base sheet may be made of temperature stable plastic sheet or polymer material.

A further alternative (a less preferred embodiment though) is to delete the adhesive between the folding layers, such as shown by the embodiment of FIG. 10. The binding edge region would then be preferably constructed with materials that allow for a secure flat folding using a folding machine, not tending to pop up and be caught in the printer.

A further example is to not make the binding region thinner than the adjacent sheet, such as by not calendering. However, then when it is in a folded position, as shown in FIG. 10, it will be thicker, perhaps twice the thickness of the adjacent sheet. This may not be a problem when a lighter weight paper such as twenty-eight or thirty-two pound ledger is used. The maximum recommended paper thickness for passing through printers can be eight, twelve or fifteen mils, for example, using a printer's multipurpose tray or by manual feeding.

The assembly 110 of FIG. 7, for example, can then be fed into a printer 180 with the sheet in a portrait feed direction, as shown in FIG. 11. (More appropriately, the tab should be illustrated on the left in FIG. 11 since the divider's binding edge is shown therein.) The folded over portion 120 by decreasing the width of the overall assembly allows for feeding into a 8½ inch feed printer 180 where the overall (unfolded) width as shown in FIG. 5 would be nine inches, for example.

The strip 64 attached to the tabbed edge of the sheet then provides an even guiding surface for contact with the feed tray guides 184, to prevent skewing of the divider sheet assembly 110 (or 50) relative to the printer 180. This divider sheet assembly 110 (without the peel off strip) can also be used with an insert feed tray as described in the previously-mentioned '879 patent application.

After the tabbed divider sheet assembly 110 has passed through the printer 180 of FIG. 11 and the printing 186, 188 on the body and the tabbed portion has been made, the strip 64 is pulled or peeled away from the divider sheet itself as shown in FIG. 12, similar to that of FIG. 3, and the folding portion 120 is folded out as shown in FIG. 12 (and depicted in FIG. 5). The unitary sheet with its prepunched binding edge and the body and tab with the desired indicia printed thereon is then ready for use. For example, it can be fitted into a three ring binder. As would be appreciated by those skilled in the art, different numbers of prepunched holes and/or different placements thereof can be provided as needed by the ultimate user. For example, it is within the scope of the invention to have the holes at the top of the sheet and the tabbed portions either on the side or at the end to fit different sizes and types of binders.

The divider assemblies described above show the releasable attachment of the strip 64 to the divider sheet as being by adhesive 66. However, it is also within the scope of the invention to have a microperforation attachment, instead of that adhesive attachment. This is shown by the embodiments 200 and 202 of FIGS. 13 and 14, respectively. The microperforated line 206 is formed in a die procedure with the shape shown in FIGS. 13 and 14. Namely, the line 206 is straight with the exception of the outwardly bulging area defining the shape and size of the tab 208.

An embodiment for a full page laser, ink-jet printable or photocopiable divider comprises paper having a thickness of approximately 6.0 mil for the divider sheet 210. The sheets would usually be formed of fairly heavy paper or light cardboard stock. The microperforations consist of cuts which vary in size from 0.0125 to 0.0135 inch and which are separated by ties that vary in size from 0.0045 to 0.0050 inch. Thus, there are between fifty-three and fifty-nine perforations per inch, with about fifty-six perforations being an average therebetween. For convenience the perforations can be referred to as in excess of about fifty perforations per inch or at least about fifty perforations per inch. It is also within the scope of the invention for the perforations to be only thirty-five perforations per inch, or in the range of from thirty-five to fifty-nine perforations per inch.

FIG. 13 shows an embodiment 200 of the present invention similar to that of FIG. 1 wherein no prepunched holes or folded-over binding edge is provided. On the other hand, FIG. 14 shows generally at 202 a microperforated embodiment employing the binding edge technology shown generally at 220 and as illustrated in FIGS. 5–12, for example. FIG. 14 also illustrates the strip or strip portion 224 as being separated from the divider sheet assembly by simply tearing along the microperforated line 206.

The line of microperforations 206 does not affect the sheet's flatness or suitability of processing by a standard printer. The line is not straight as one zone protrudes away from the opposite side, the protrusion being shaped to outline the shape of a conventional index tab, as mentioned above. The excess strip portion 224 is to be discarded after the sheet has been processed by the printer and the strip removed (torn away) from the sheet.

Figure 15:
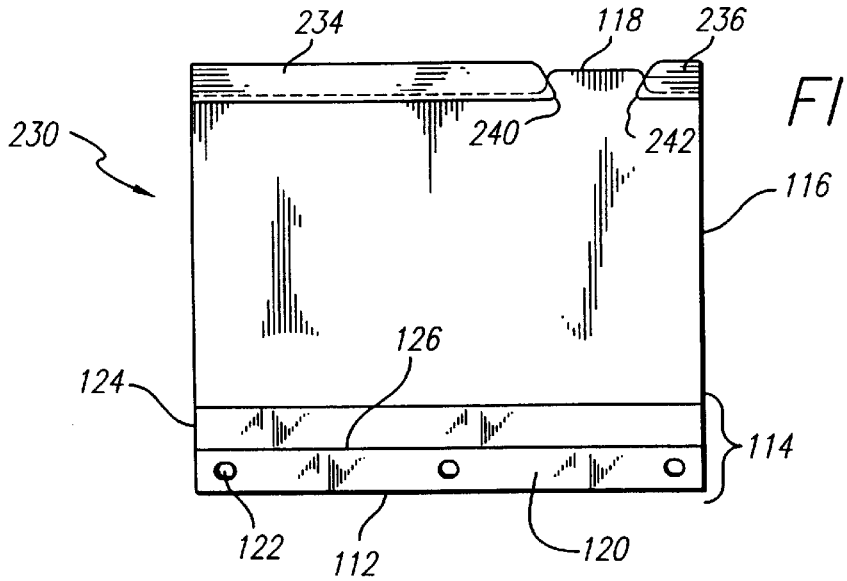
FIG. 15 is a front elevational view of a sixth index divider sheet assembly of the invention.

A further embodiment of the present invention is illustrated generally at 230 in FIG. 15. It is similar to the embodiment of FIG. 5, for example, except in the construction of the paper strip (64). The paper strip in embodiment 230 is formed of two pieces, namely, paper strip portions 234 and 236. The paper strip portions 234 and 236 are releasably adhered to the body portion 16 with glue (66) or the like as previously described. They are dimensioned and positioned on the body portion 116 along the tab edge thereof so that their adjacent ends 240, 242 are spaced apart with the tab 118 in between. That is, no part of the strip (234, 236) covers or extends across the tab 118. Thus, both sides of the tab 118 are uncovered (not covered) by the strip and the printer advantageously can print on either or both sides of the tab as it passes therethrough. This is similar to the microperforated attachment embodiments 200 and 202. Of course, the two piece (paper strip portions 234 and 236) construction can be used without a debossed binding edge region 114 (such as in FIGS. 1, 3 and 4).

The present invention thus includes, generally speaking, one or more strips releasably attached to a flat object (such as a paper sheet). The strip is attached so as to extend out from an uneven or non-linear or non-perpendicular edge or side of the object so that the assembly formed by that object and strip(s) has a straight linear perpendicular edge corresponding to and in place of the object's uneven edge. The assembly can then be passed through a printer or copier with reduced likelihood of skewing or jamming. After the printing on the flat object, the strip is cleanly removed therefrom.

One preferred embodiment of this invention as discussed in detail above includes the flat object being an index divider sheet with the uneven edge being the outwardly protruding tab thereof. However, the present invention can be used with generally any flat object having one or more uneven, non-linear or non-perpendicular edges. Further examples thereof are shown in FIGS. 16–23 and discussed in detail below.

Figure 16:
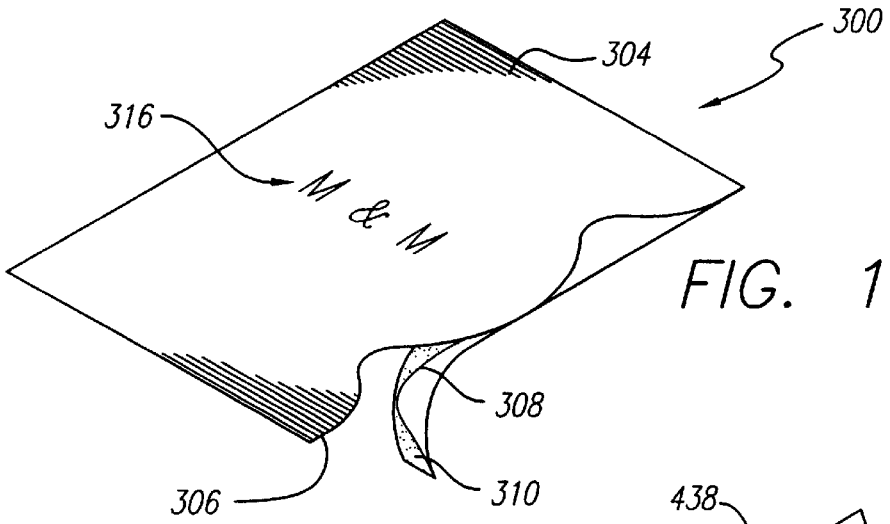
FIG. 16 is a perspective view of an alternative sheet assembly of the present invention after passing through a printer or copier and with the peel off strip thereof partially removed.
Figure 18:
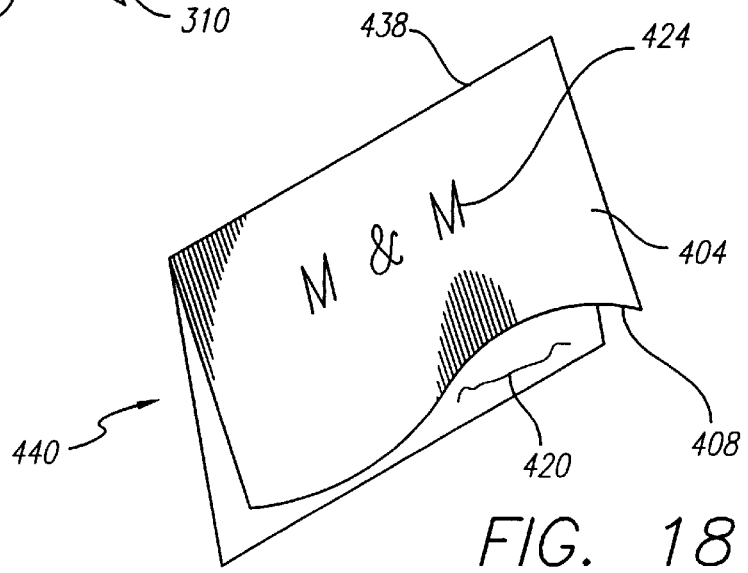
FIG. 18 is a perspective view of one of the business cards of the assembly of FIG. 17, in a generally finished condition.

FIG. 16 shows generally at 300 an embodiment including an odd shaped or odd sized sheet 304, having a wavy or non-linear side (die cut) edge 306. The paper strip 308 having, for example, a width of one inch and a length of eleven inches, is releasably adhered to the sheet 304 on the back side thereof with an adhesive 310, such as the previously mentioned adhesive(s). The adhesive 310 can be applied to the paper strip 308 in a pattern conforming to the uneven edge of the sheet 304 using a gravure-type application process. The sheet 304 can have a thickness of two to fifteen mil and can be a one hundred pound weight vellum such as that available from Simpson Paper Company. The paper strip 308 can be twenty-four pound bond paper or equivalent film, having a thickness of approximately 3½ to four mil. It is preferably thin, thinner than the sheet 304, so that the strip plus the sheet are together not too thick to pass through the printer.

The assembly 300 is passed through the printer or copier (72) and the desired indicia 316 printed on the sheet 304. The strip 308 is then peeled off the sheet 304 as is shown in the lower right of FIG. 16. Because a small/fine detailed edge, preferably die cut, is likely needed for the uneven (wavy) edge, the microperforated strip alternative attachment is less desirable for this embodiment.

FIGS. 17–23 show embodiments of this invention wherein each sheet to be individually passed through the printer or copier has microperforated or other weakened or tear lines dividing the sheet in separate individual units. Printing by the printer or copier would likely be, but need not be, on each of the units. It may also be on the front and/or back sides of the sheet. The sheets can also be provided with scored fold lines, along which the units can be folded into the desired shapes. For example, the folded units can be holiday or greeting cards and the non-folded units can be tabbed flip file cards, as discussed below.

FIG. 17 shows generally at 400 a sheet assembly including a sheet 404, having an uneven (wavy, similar to edge 306 of FIG. 16) edge 408 and an adhesive strip 412, along the edge, and extending out therefrom to define a linear edge 416 for the sheet assembly. Again, the linear edge 416 helps feed the sheet 404 through the printer or copier.

After being fed through the printer or copier and the desired indicia (e.g., 420, 424), printed thereon, the strip 412 is peeled off, the sheet 404 is torn along the existing microperforation lines 430, 434, into the (three) individual units, and each of the units is folded in half along its score line 438. Three holiday or greeting cards are thereby formed. An example of one of them is shown generally at 440 in FIG. 18.

The sheet 404, for example, can have the following size and specifications: 3½ by four inches, twelve mil thick, made from heavy card stock such as one hundred pound Tiara Starwhite Vicksburg Text Vellum Finish paper. The microperforation lines 430, 434 can consist of cuts which vary in length from 0.0125 to 0.0135 inch and which are separated by ties that vary in length from 0.0045 to 0.0050 inch. Thus, there are between fifty-three and fifty-nine perforations per inch, with an average being fifty-six, or alternatively between thirty-five and fifty-nine perforations per inch.

A variation of the assembly and card is shown in FIGS. 19 and 20 at 450 and 454, respectively. The main difference is that the uneven edge 460, instead of having a wavy configuration, has a jagged configuration.

A further card embodiment of this invention is shown generally at 500 in FIG. 21. As can be understood from the drawings, it differs from cards 440 and 454 in that instead of a jagged (or wavy) configuration it has a series of very fine and detailed shapes 504 cut in at spaced locations along the (bottom) edge 510. In FIG. 21 these shapes 504 are shown as being trees such as pine or Christmas trees. Of course, other shapes as would be apparent to those skilled in the art are within the scope of the invention. An adhesive peel off strip (412) is used to make the edge continuous and straight. A microperforated strip embodiment would likely not work well for the card 500 of FIG. 21 because it would not provide the needed fine detail for the shapes 504. Rather, the shapes 504 would be die cut and an adhesive peel off strip (412) would be used.

If more than one side is "uneven," then separate peel off or tear off strips can be provided for each side. The strips need not be separate, but rather can be connected or continuous in an "L" or "U" or even a picture frame shape. An example of using more than one strip for a single sheet is shown in FIG. 22.

Assembly 550 in FIG. 22 has strips 554, 558 adhered to both side edges 560, 564, respectively. As can be understood from FIGS. 22 and 23, sheet 570 of assembly 550 has central horizontal and vertical microperforation lines 574, 578, dividing the sheet into four quadrants or units. Each unit has its own outwardly extending tab 580, 582, 584, 586. By having the tabs extending outwardly, relative to the sheet, clean die-cut defining edge lines are possible. The strips 554, 558 on the tabbed edges make those edges 590, 592 straight for passing through a printer or copier. The paper sheet 570 can be heavy card stock, such as one hundred pound Tiara Starwhite Vicksburg Vellum Finish paper. The microperforation lines 574, 578 can have specifications similar to the previously-described microperforation lines 430, 434. The strips 554, 558 can be eight inches long by one inch wide and have specifications the same as the previously-described strips 64 and 308.

After passing through the printer or copier and the desired indicia printed on each of the units, the further forming steps are illustrated in FIG. 23. The strips are peeled off and the units are separated from one another along the microperforation lines. Four units are thereby formed, each one configured and dimensioned as a tabbed, flip file card.

In summary, laser and ink-jet printers, standard and wide tray, use mechanical, optical or a combination of two systems to sense paper or other materials feeding into and through the printers. The sensors are located in different positions across the pathway in the printer as determined by the make and model thereof. When the printer is integrated with a personal computer, the software used determines the area/location of printing. When a specific paper size is selected from the software such as tabloid, eleven inch by seventeen inch, the printer sensor confirms the presence of the sheet for printing. If the printer "senses" the material, the software instructions to print in an area will be carried out. On the other hand, if the printer "senses" the non-presence of the material, printing in the area will not occur. The Hewlett Packard 4V paper sensor is in the center of the paper pathway. The third tab position is always "sensored" and the tab area is printed. Positions one, two, four and five will not print according to the prior art since the sensor signals that a divider is not present even though the software has printing instructions for the tab position as a tabloid area. When the divider is fixed to a tabloid sheet, printing occurs at positions one, two, four and five, since position three sensor contact signals that a sheet of paper is present Instead of using a full size tabloid, a strip of paper fixed to one side of the divider running the length of the tab edge at the tab height will perform the same function. The paper strip signals paper presence to the sensor and effects printing in positions one, two, four and five. The strip is cleanly removable after printing of the tab side of the divider and discarded. Alternatively, the strip can be formed as two strip portions, one on either side of the tab.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. An index tab sheet assembly, comprising:

an index tab sheet having an edge and a tab extending out from said edge, said tab having first and second opposite tab faces; and a strip releasably attached with releasable adhesive to said sheet in an attached position;

said strip when in the attached position extending out from said edge to improve feed of said sheet into or transport of said sheet through a printer or copier for a printing operation on said sheet;

said strip being removable from the attached position on said sheet after the printing operation; and said strip when in the attached position not covering any substantial portion of either of said first and second tab faces such that the printing operation can be on either or both of said tab faces.

2. The assembly of claim 1 wherein said strip when in the attached position covers only a corner of one of said tab faces adjacent said edge.

3. The assembly of claim 1 wherein the printing operation is on both of said tab faces.

4. The assembly of claim 1 wherein said strip comprises a lighter weight paper than that of said sheet.

5. The assembly of claim 1 wherein said strip comprises a plastic strip.

6. The assembly of claim 1 wherein said strip has a width of 0.75 to 1.50 inches.

7. The assembly of claim 1 wherein said strip when in the attached position extends a distance out from said edge which is slightly greater than a distance which said tab extends out from said edge.

8. The assembly of claim 1 wherein said strip defines a first strip, and further comprising a second strip which is releasably attached with releasable adhesive to said sheet in an attached position.

9. The assembly of claim 8 wherein said second strip when in the attached position extends out from said edge and is positioned on an opposite end of said tab as said first strip, said second strip is removable from the attached position on said sheet after the printing operation, and said second strip when in the attached position does not cover any substantial portion of either of said first and second tab faces such that the printing operation can be on either or both of said tab faces.

10. The assembly of claim 9 wherein said first and second strips when in the attached positions are attached to the same face of said sheet.

11. The assembly of claim 9 wherein said first and second strips when in the attached positions have their adjacent ends spaced from one another with said tab therebetween.

12. The assembly of claim 9 wherein said second strip when in the attached position covers only a corner of one of said tab faces adjacent said edge.

13. The assembly of claim 1 wherein said edge is a side edge of said sheet, said strip extends the full length of said side edge, and said sheet is fed in a portrait direction into the printer or copier.

14. The assembly of claim 1 wherein said sheet includes a folded-over portion along an edge opposite to said sheet edge, and said folded-over portion is adapted to be unfolded after the printing operation.

15. The assembly of claim 14 wherein said folded-over portion includes a plurality of spaced apertures.

16. The assembly of claim 1 wherein said sheet is free from perforations and perforation ties.

17. An index tab sheet assembly, comprising:

an index tab sheet having an edge and a tab extending out from said edge; and a strip releasably attached to said sheet in an attached position extending out from said edge to improve feed of said sheet into or transport of said sheet through a printer or copier for a printing operation on said sheet, said strip being removable from the attached position on said sheet after the printing operation.

18. The assembly of claim 17 wherein said strip is releasably attached to said sheet with releasable adhesive.

19. The assembly of claim 18 wherein said adhesive is a fugitive type of adhesive.

20. The assembly of claim 17 wherein said strip is releasably attached to said sheet with perforations.

21. The assembly of claim 17 wherein said sheet has straight edges free from perforation tie protrusions on at least three edges thereof.

22. The assembly of claim 17 wherein the printing operation is on a face of said tab.

23. The assembly of claim 17 wherein said strip is made from a first paper and said sheet is made from a second paper different than said first paper.

24. The assembly of claim 23 wherein said first paper is a lighter weight paper than said second paper.

25. The assembly of claim 17 wherein said strip when in the attached position extends a distance out from said edge which is slightly greater than a distance which said tab extends out from said edge.

26. The assembly of claim 17 wherein perforations separate said strip from said sheet.

27. The assembly of claim 17 wherein said strip when in the attached position defines a leading edge for feeding said assembly into the printer or copier.

28. The assembly of claim 17 wherein said strip when in the attached position defines with said sheet, a rectangle.

29. The assembly of claim 17 wherein said sheet is separate from similar said sheets and is thereby adapted to be individually and separately fed into the printer or copier.

30. The assembly of claim 17 wherein said sheet has a folded-over edge opposite to said edge.

31. The assembly of claim 30 wherein said folded-over edge is releasably held in a folded-over position relative to said sheet during the printing operation.

32. The assembly of claim 31 wherein said folded-over edge is held in the folded-over position with releasable adhesive on said sheet.

33. The assembly of claim 31 wherein said folded-over edge includes a plurality of spaced apertures.

34. The assembly of claim 17 wherein said sheet has a reinforced binding edge opposite to said edge, said binding edge being attached to said sheet during the printing operation.

35. The assembly of claim 34 wherein said reinforced binding edge has a plurality of spaced apertures.

36. The assembly of claim 17 wherein said sheet comprises a non-tractor feed paper sheet adapted for individual and separate feed into the printer or copier.

37. The assembly of claim 17 wherein said strip when in the attached position defines a side edge of said assembly, perpendicular to a leading edge, when said sheet is fed into the printer or copier.

38. The assembly of claim 17 wherein said strip extends the entire length of said sheet.

39. The assembly of claim 17 wherein said sheet is free from perforations and perforation ties.

40. An index tab sheet assembly, comprising:

an index tab sheet having an edge and a tab extending out from said edge;

a strip releasably attached to said sheet in an attached position extending out from said edge to improve individual and separate feed of said sheet into or individual and separate transport of said sheet through a printer or copier for a printing operation on said sheet, said strip being removable from the attached position on said sheet after the printing operation; and a folded-over portion attached to said sheet and in a folded-over position relative to said sheet during the printing operation and adapted to be unfolded after the printing operation.

41. The assembly of claim 40 wherein said folded-over portion comprises a folded-over edge which is opposite to said edge.

42. The assembly of claim 41 wherein said folded-over portion comprises a folded-over edge which is releasably held in the folded-over position relative to said sheet during the printing operation.

43. The assembly of claim 42 wherein said folded-over edge is held in the folded-over position with releasable adhesive on said sheet.

44. The assembly of claim 40 wherein said folded-over portion includes a plurality of spaced apertures.

45. The assembly of claim 40 wherein said folded-over portion has a thinner thickness than the thickness of said sheet.

46. The assembly of claim 40 wherein said strip is releasably attached to said sheet with releasable adhesive.

47. The assembly of claim 40 wherein said strip is releasably attached to said sheet with perforations.

48. The assembly of claim 40 wherein said sheet has straight edges free from perforation tie protrusions on at least three edges thereof.

49. The assembly of claim 40 wherein the printing operation is on a face of said tab.

50. The assembly of claim 40 wherein said strip is made from a first paper and said sheet is made from a second paper different than said first paper.

51. The assembly of claim 50 wherein said first paper is a lighter weight paper than said second paper.

52. The assembly of claim 40 wherein said strip when in the attached position extends a distance out from said edge which is slightly greater than a distance which said tab extends out from said edge.

53. The assembly of claim 40 wherein perforations separate said strip from said sheet.

54. The assembly of claim 53 wherein said perforations define three perimeter sides of said tab.

55. The assembly of claim 40 wherein said strip when in the attached position defines a leading edge for feeding said assembly into the printer or copier.

56. The assembly of claim 40 wherein said strip when in the attached position defines a side edge of said assembly when said assembly is fed into the printer or copier.

57. The assembly of claim 40 wherein said strip when in the attached position defines with said sheet, a rectangle.

58. The assembly of claim 40 wherein said sheet is separate from similar said sheets and comprises non-tractor feed paper sheet adapted for individual and separate feed into the printer or copier.

59. The assembly of claim 40 wherein said strip extends the entire length of said sheet.

60. The assembly of claim 40 wherein said sheet is free from perforations and perforation ties.

61. An index tab divider sheet assembly, comprising:

an index tab divider sheet having a tab edge, a tab extending out from said tab edge, an opposite linear edge opposite to said tab edge, and two parallel spaced linear edges perpendicular to said tab edge; and a strip releasably attached to said sheet in an attached position extending out from said tab edge and extending from one of said parallel spaced linear edges to the other to improve feed of said sheet into or transport of said sheet through a printer or copier for a printing operation on said sheet, said strip when in the attached position defines a rectangle with said sheet, said strip being removable from the attached position on said sheet after the printing operation whereby a printed index tab divider sheet is formed.

62. The assembly of claim 61 wherein said strip when in the attached position extends a distance out from said tab edge which is slightly greater than a distance which said tab extends out from said edge.

63. The assembly of claim 61 wherein said strip when in the attached position has the same constant width on both sides of said tab from opposite end edges of said tab to both of said parallel spaced linear edges.

64. The assembly of claim 61 wherein said strip is releasably attached to said sheet with perforations.

65. The assembly of claim 61 wherein said opposite linear edge and said two parallel spaced linear edges are free from perforation tie protrusions.

66. The assembly of claim 61 wherein said opposite linear edge defines an edge of a folded-over portion of said sheet which is folded over onto a body of said sheet during the printing operation and is subsequently unfolded.

67. The assembly of claim 66 wherein said folded-over portion is releasably held in a folded-over position relative to the body for feeding into the printer or copier and transport therethrough.

68. The assembly of claim 66 wherein said folded-over portion is a reinforced binding portion.

69. The assembly of claim 66 wherein said folded-over portion includes a plurality of spaced apertures.

70. The assembly of claim 62 wherein said printed index tab divider sheet is 8½ or nine inches by 11 inches.

71. The assembly of claim 62 wherein said sheet includes a plurality of spaced ring apertures spaced inwardly away from said opposite edge.

72. The assembly of claim 62 wherein said strip when in the attached position is releasably attached to said sheet with releasable adhesive.

73. The assembly of claim 62 wherein said strip when in the attached position extends ½ to ¾ inch out from said tab edge and ¼ inch out from said tab.

74. An assembly, comprising:

an index tab sheet including (a) a main sheet body having a tab edge and (b) a tab extending out from the tab edge;

a strip releasably attached to the sheet so as to extend out beyond the tab edge and adjacent to the tab; and releasable adhesive which releasably attaches the strip to the sheet.

75. An assembly, comprising:

an index tab sheet including (a) a main sheet body having a tab edge and (b) a tab extending out from the tab edge; and a strip releasably attached to the sheet so as to extend out beyond the tab edge and adjacent to the tab;

wherein the strip is releasably attached directly on and to a rear face of the sheet body.

76. An assembly, comprising:

an index tab sheet including (a) a main sheet body having a tab edge and (b) a tab extending out from the tab edge; and a strip releasably attached to the sheet so as to extend out beyond the tab edge and adjacent to the tab;

wherein the strip passes directly behind the tab and across a rear face thereof.

77. An assembly, comprising:

an index tab sheet including (a) a main sheet body having a tab edge and (b) a tab extending out from the tab edge; and a strip releasably attached to the sheet so as to extend out beyond the tab edge and adjacent to the tab;

wherein the strip comprises a lighter weight paper than that of the sheet.

78. An assembly, comprising:

an index tab sheet including (a) a main sheet body having a tab edge and (b) a tab extending out from the tab edge; and a strip releasably attached to the sheet so as to extend out beyond the tab edge and adjacent to the tab;

wherein the strip defines an elongate rectangle having a constant width from one end of the strip to the other.

* * * * *